US008257015B2

(12) United States Patent
Bowen et al.

(10) Patent No.: US 8,257,015 B2
(45) Date of Patent: Sep. 4, 2012

(54) APPARATUS FOR COOLING ROTARY COMPONENTS WITHIN A STEAM TURBINE

(75) Inventors: Mark Kevin Bowen, Niskayuna, NY (US); Stephen Roger Swan, Clifton Park, NY (US); Michael Earl Montgomery, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 1493 days.

(21) Appl. No.: 12/031,049

(22) Filed: Feb. 14, 2008

(65) Prior Publication Data

US 2009/0208323 A1 Aug. 20, 2009

(51) Int. Cl.
*F01D 5/08* (2006.01)

(52) U.S. Cl. ..... 415/1; 415/115; 415/116; 415/180; 60/782; 60/806

(58) Field of Classification Search ..... 60/782, 60/806; 415/180, 1, 116, 115, 161.1
See application file for complete search history.

(56) References Cited

U.S. PATENT DOCUMENTS 4,466,239 A 8/1984 Napoli et al.
5,253,976 A * 10/1993 Cunha ..... 415/114
5,399,065 A * 3/1995 Kudo et al. ..... 415/115
5,609,466 A * 3/1997 North et al. ..... 415/115
5,645,397 A 7/1997 Soechting et al.
5,676,521 A * 10/1997 Haynes ..... 415/169.1
6,397,604 B2 6/2002 Eldrid et al.
7,007,488 B2 3/2006 Orlando et al.
7,101,144 B2 * 9/2006 Haje et al. ..... 415/115
7,287,956 B2 * 10/2007 Bracken et al. ..... 415/173.3
2006/0005546 A1 1/2006 Orlando et al.
2007/0137213 A1 6/2007 Rickert et al.

FOREIGN PATENT DOCUMENTS

JP 60035103 A * 2/1985

* cited by examiner

*Primary Examiner* — Igor Kershteyn
(74) *Attorney, Agent, or Firm* — Armstrong Teasdale LLP

(57) ABSTRACT

A steam turbine is provided. The steam turbine includes a rotor shaft including a plurality of buckets coupled thereto. The steam turbine further includes a stationary component coupled to a steam turbine casing, wherein the stationary component is coupled upstream from the buckets such that a wheelspace is defined between the buckets and the stationary component. The stationary component includes a first ring coupled to the steam turbine, a second ring coupled to the steam turbine radially inward from the first ring, and at least one airfoil extending between the first ring and the second ring. The steam turbine includes a cooling fluid flowpath defined through at least the first ring, the airfoil, and the second ring. The cooling fluid flowpath is configured to channel a cooling fluid to the wheelspace.

20 Claims, 3 Drawing Sheets

APPARATUS FOR COOLING ROTARY COMPONENTS WITHIN A STEAM TURBINE

BACKGROUND OF THE INVENTION

This invention relates generally to cooling a rotary component, and more specifically, to cooling a wheelspace in a stage of a steam turbine.

At least some known stationary and rotating components found in steam turbine engines are subjected to temperature, pressure, and centrifugal loadings during normal operations. The design of the high-pressure (HP) and/or intermediate-pressure (IP) sections of known steam turbine engines may be complex because of the high temperatures and pressures of the steam supplied to the steam turbine and because of the creep experienced by such components. Known temperatures and pressures that satisfy the aerodynamic and thermodynamic design requirements for at least some known turbines require a corresponding acceptable mechanical design solution. Known design solutions focus on bucket and rotor materials and/or geometries, steam turbine operating temperatures and/or pressures, and/or piping solutions external to the steam flowpath.

To achieve an acceptable mechanical design for some known steam turbine components, some known designs require that such components be exposed to steam temperatures that are at lower temperatures than similar components would typically be exposed to during normal operations of known turbine sections. However, limiting operating temperatures and pressures within the turbine limits the thermodynamic design space and may result in decreased turbine performance.

One known design solution involves changing the rotor geometry and materials to make a rotor that is acceptable for long-term operations, without providing external cooling. However, such geometries are generally more costly, reduce stage efficiency, and/or require costly, higher capability materials than designs that use an adequate cooling scheme. One known cooling scheme uses pipes routed through a steam flowpath to supply a cooling steam flow. For example, such pipes may be positioned within first-reheat, double-flow tub stages. Such pipes however create an obstruction within the main steam flow and add complexity to the system.

BRIEF DESCRIPTION OF THE INVENTION

In one aspect, a method for cooling a rotating component within a steam turbine is provided. The method includes channeling a cooling fluid through an outer plenum defined in a stationary component of the steam turbine and channeling the cooling fluid from the outer plenum through a passageway defined in an airfoil of the stationary component. The cooling fluid is discharged from the airfoil passageway through an inner plenum of the stationary component to facilitate cooling an adjacent rotating component.

In another aspect, an annular stationary component for use with a steam turbine is provided. The stationary component includes a first ring having a first plenum defined therein and a second ring having a second plenum and at least one outlet defined therein. The second plenum is coupled in flow communication with the outlet, and the second ring is radially inward from the first ring. The stationary component further includes at least one airfoil extending between the first ring and the second ring. The airfoil includes a passageway extending therethrough from a first end of the airfoil to a second end of the airfoil. The airfoil passageway is in flow communication with the first plenum and the second plenum.

In still another aspect, a steam turbine is provided. The steam turbine includes a rotor shaft including a plurality of buckets coupled thereto. The steam turbine further includes a stationary component coupled to a steam turbine casing, wherein the stationary component is coupled upstream from the buckets such that a wheelspace is defined between the buckets and the stationary component. The stationary component includes a first ring coupled to the steam turbine, a second ring coupled to the steam turbine radially inward from the first ring, and at least one airfoil extending between the first ring and the second ring. The steam turbine includes a cooling fluid flowpath defined through at least the first ring, the airfoil, and the second ring. The cooling fluid flowpath is configured to channel a cooling fluid to the wheelspace.

DETAILED DESCRIPTION OF THE INVENTION

Figure 1:
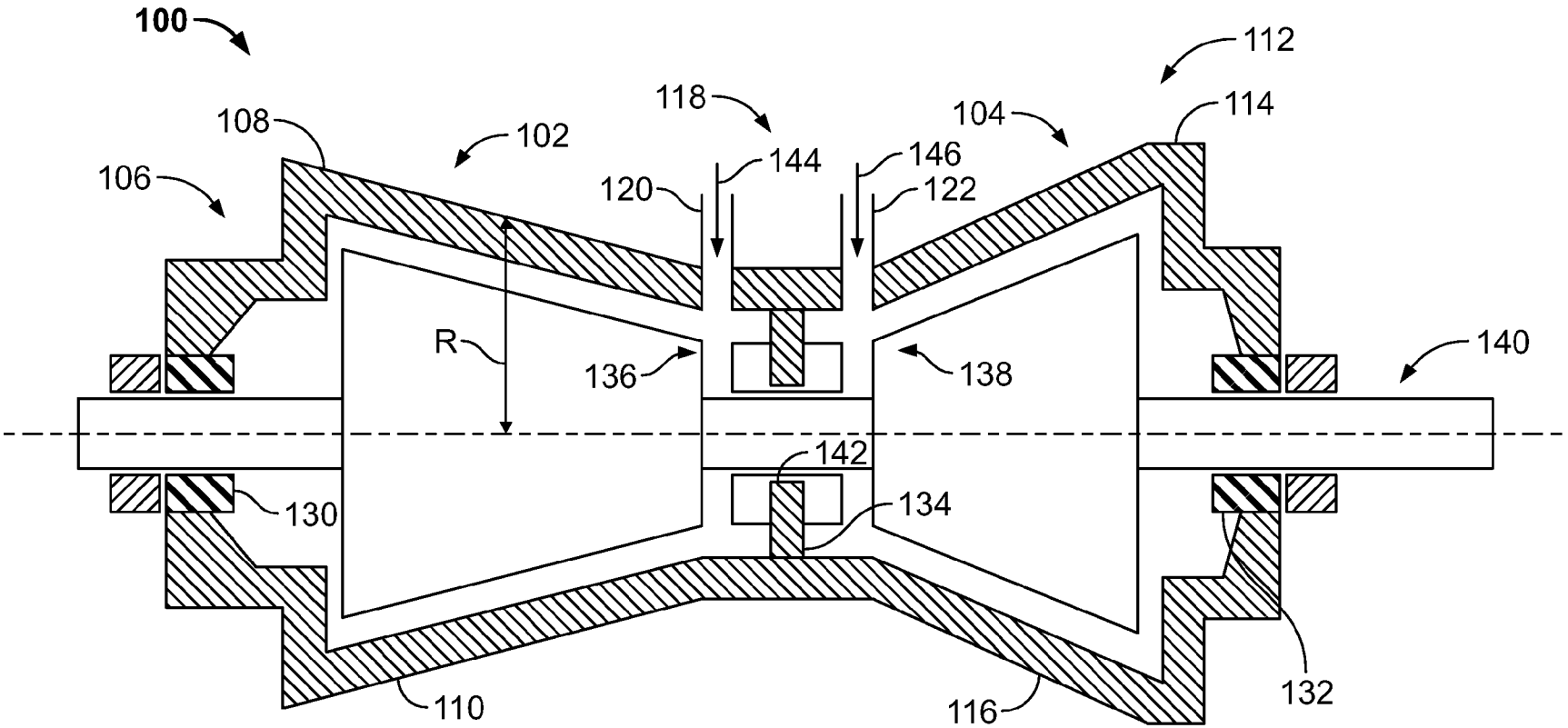
FIG. 1 is a schematic view of an exemplary steam turbine engine.

FIG. 1 is a schematic illustration of an exemplary opposed-flow steam turbine engine 100 including a high-pressure (HP) section 102 and an intermediate-pressure (IP) section 104. An HP shell, or casing, 106 is divided axially into upper and lower half sections 108 and 110, respectively. Similarly, an IP shell 112 is divided axially into upper and lower half sections 114 and 116, respectively. In the exemplary embodiment, shells 106 and 112 are inner casings. Alternatively, shells 106 and 112 are outer casings. In the exemplary embodiment, shells 106 and 112 are sealed such that ambient air is not admitted into engine 100. A central section 118 positioned between HP section 102 and IP section 104 includes a high-pressure steam inlet 120 and an intermediate-pressure steam inlet 122.

An annular section divider 134 extends radially inwardly from central section 118 towards a rotor shaft 140 that extends between HP section 102 and IP section 104. More specifically, divider 134 extends circumferentially around a portion of rotor shaft 140 between a first HP section inlet nozzle 136 and a first IP section inlet nozzle 138. Divider 134 is received in a channel 142.

During operation, high-pressure steam inlet 120 receives high-pressure/high-temperature steam 144 from a steam source, for example, a power boiler (not shown). Steam 144 is routed through HP section 102 from inlet nozzle 136 wherein work is extracted from the steam 144 to rotate rotor shaft 140 via a plurality of turbine blades, or buckets 202 (shown in FIGS. 2 and 3) that are coupled to shaft 140. Each set of buckets 202 includes a corresponding diaphragm 204 (shown in FIGS. 2 and 3) that facilitates routing of steam 144 to associated buckets 202. The steam 144 exits HP section 102 and is returned to the boiler wherein it is reheated. Reheated steam 146 is then routed to intermediate-pressure steam inlet 122 and returned to IP section 104 via inlet nozzle 138 at a reduced pressure than steam 144 entering HP section 102, but at a temperature that is approximately equal to the temperature of steam 144 entering HP section 102. Work is extracted from the steam 146 in IP section 104 in a manner substantially similar to that used for HP section 102 via a system of rotating and stationary components. Accordingly, an operating pressure within HP section 102 is higher than an operating pressure within IP section 104, such that steam 144 within HP section 102 tends to flow towards IP section 104 through leakage paths that may develop between HP section 102 and IP section 104.

In the exemplary embodiment, steam turbine engine 100 is an opposed-flow high-pressure and intermediate-pressure steam turbine combination. Alternatively, steam turbine engine 100 may be used with any individual turbine including, but not being limited to low-pressure turbines. In addition, the present invention is not limited to being used with opposed-flow steam turbines, but rather may be used with steam turbine configurations that include, but are not limited to, single-flow and double-flow turbine steam turbines.

Figure 2:
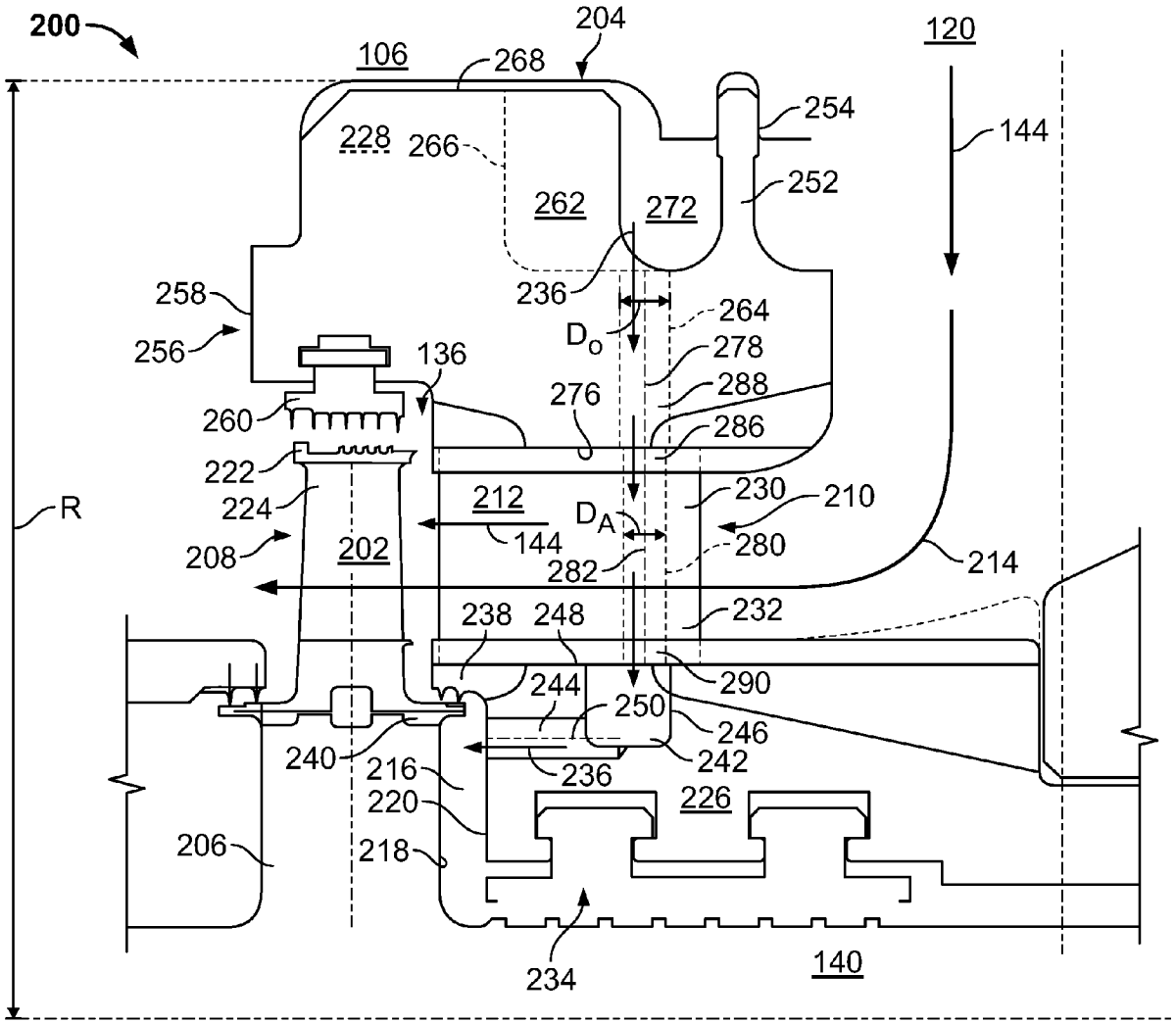
FIG. 2 is a cross-sectional view of an exemplary first turbine stage that may be used with the steam turbine shown in FIG. 1.
Figure 3:
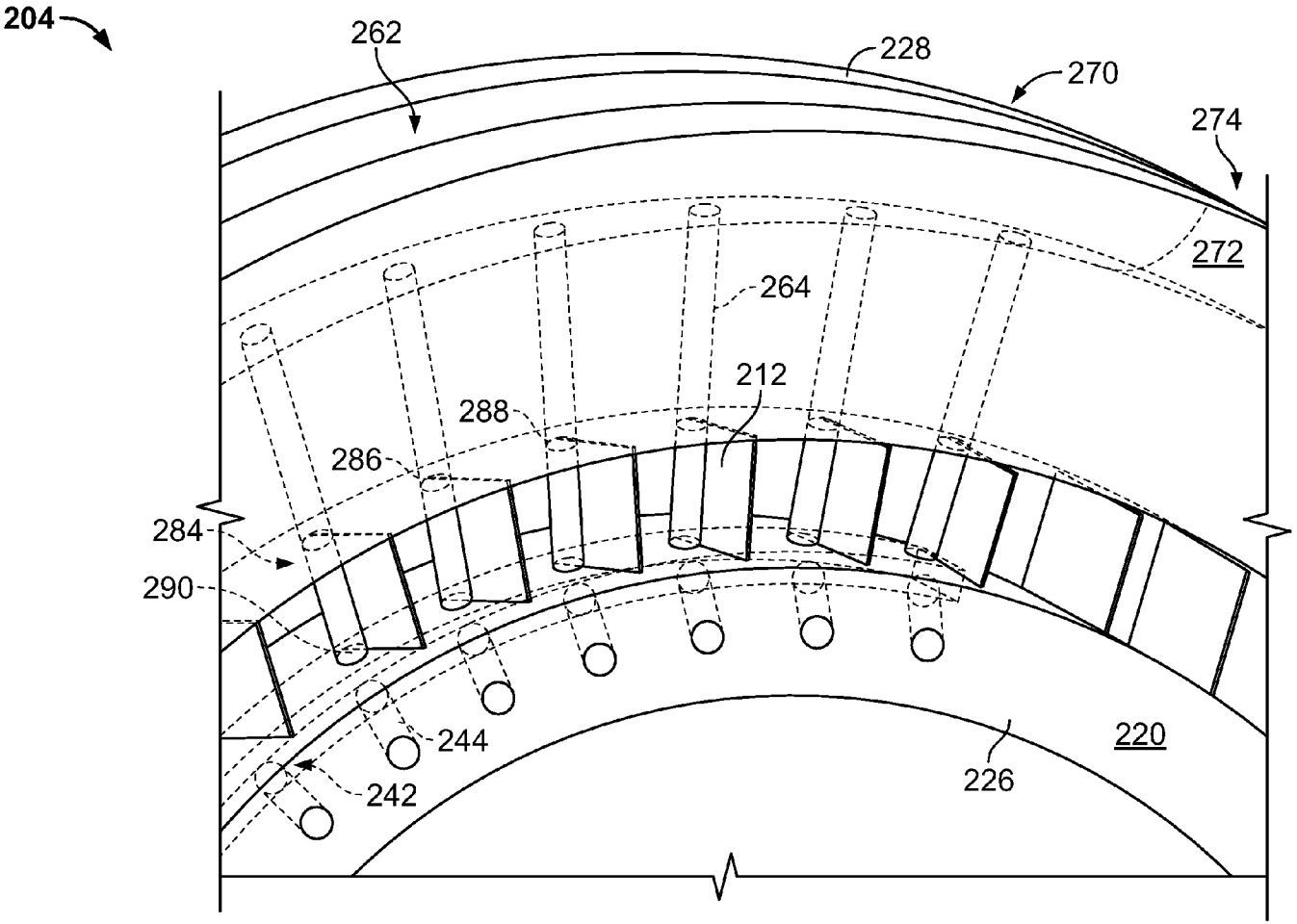
FIG. 3 is a perspective view of an exemplary stationary component that may be used with the turbine stage shown in FIG. 2.

FIG. 2 is a cross-sectional view of an exemplary first turbine stage 200 that may be used with steam turbine engine 100. FIG. 3 is a perspective view of a diaphragm 204 that may be used with turbine stage 200. In the exemplary embodiment, diaphragm 204 is fabricated from alloy steels, such as, for example, 12% Chromium (Cr), or better, forgings, or bar stock. Furthermore, in the exemplary embodiment, the external geometry of diaphragm 204 is any known external geometry for a stationary component within a steam turbine.

In the exemplary embodiment, turbine stage 200 includes first high-pressure section inlet nozzle 136. Although turbine stage 200 is described herein as a first turbine stage for use in a high-pressure steam turbine, the embodiments described herein are not limited to only being used with a first stage, but rather may be used with any turbine stage and/or any steam turbine having a cooling fluid flow applied thereto. In the exemplary embodiment, stage 200 includes a rotor wheel 206 and diaphragm 204. Rotor wheel 206 includes a row 208 of buckets 202, and diaphragm 204 includes a row 210 of airfoils 212. A main flowpath 214 is defined through high-pressure section 102 (shown in FIG. 1) such that steam 144 (shown in FIG. 1) flows through airfoils 212 and buckets 202 during turbine operation. More specifically, each airfoil 212 directs steam 144 downstream through axially-adjacent buckets 202. Further, a wheelspace 216 is defined between an upstream surface 218 of wheel 206 and a downstream surface 220 of diaphragm 204. In the exemplary embodiment, wheel 206 is coupled to rotor shaft 140 (shown in FIG. 1), and each bucket 202 rotates wheel 206 and rotor shaft 140 when steam 144 contacts bucket 202. In the exemplary embodiment, each bucket 202 includes a seal 222 that is coupled to a bucket tip 224.

In the exemplary embodiment, diaphragm 204 includes a stationary inner ring 226 and a stationary outer ring 228. An inner end 232 of airfoil 212 is coupled to inner ring 226 and an outer end 230 of airfoil 212 is coupled to outer ring 228. In the exemplary embodiment, inner ring 226 includes a rotor seal 234 that is positioned adjacent to rotor shaft 140 to facilitate preventing steam 144 and/or cooling fluid 236 from flowing between inner ring 226 and rotor shaft 140. In the exemplary embodiment, cooling fluid 236 is a cooling steam. Alternatively, cooling fluid 236 is any suitable fluid for cooling stage 200 and that enables steam turbine engine 100 to function as described herein.

Furthermore, in the exemplary embodiment, inner ring 226 also includes a wheel seal 238 that is positioned adjacent to an upstream wheel projection 240 to facilitate preventing steam 144 from flowing from main flowpath 214 into wheelspace 216. Inner ring 226 also includes a cooling fluid inner plenum 242 and a plurality of cooling fluid outlets 244. In the exemplary embodiment, inner plenum 242 is an annular slot 246 defined within an outer surface 248 of inner ring 226. Moreover, in the exemplary embodiment, inner plenum 242 and each outlet 244 is formed integrally within inner ring 226. In one embodiment, inner ring 226 is a single piece. In an alternative embodiment, inner ring 226 is formed from a plurality of segments (not shown). Further, in the exemplary embodiment, each cooling fluid outlet 244 extends from inner plenum 242 through diaphragm downstream surface 220. In the exemplary embodiment, a centerline 250 of outlet 244 is oriented substantially perpendicularly to a turbine radius R (shown in FIG. 1). In another embodiment, outlet centerline 250 is oriented obliquely with respect to turbine radius R.

In the exemplary embodiment, outer ring 228 includes a steam seal 252 that is positioned adjacent to high-pressure steam inlet 120 (shown in FIG. 1) to facilitate preventing steam 144 from flowing between outer ring 228 and shell 106 (shown in FIG. 1). Steam seal 252 may be either internal to diaphragm 204 or at an interface 254 defined between diaphragm 204 and shell 106. In the exemplary embodiment, outer ring 228 also includes a wheel seal 256 that is positioned on a downstream surface 258 and a bucket seal 260 coupled to an inner surface. Seals 256 and 260 facilitate preventing steam 144 from flowing from main flowpath 214 into shell 106. More specifically, in the exemplary embodiment, bucket seal 260 is configured to engage with bucket tip seal 222.

Outer ring 228 also includes a cooling fluid outer plenum 262 and a plurality of cooling fluid passages 264. In the exemplary embodiment, outer plenum 262 is an annular slot 266 that is defined within an outer surface 268 of outer ring 228. Furthermore, in the exemplary embodiment, outer plenum 262 is only defined in a first portion 270 of outer ring 228. A channel 272 is defined within a second portion 274 of outer ring 228, wherein second portion 274 is the portion of outer ring 228 not included in first portion 270.

In the exemplary embodiment, outer plenum 262 and each passage 264 is formed integrally with outer ring 228. In one embodiment, outer ring 228 is a single piece. In an alternative embodiment, outer ring 228 includes a plurality of segments (not shown). Further, in the exemplary embodiment, each cooling fluid passage 264 extends from outer plenum 262 through outer ring 228 and outer ring inner surface 276. In the exemplary embodiment, a centerline 278 of passage 264 is oriented substantially parallel to turbine radius R. In another embodiment, passage centerline 278 is oriented obliquely with respect to turbine radius R. Furthermore, in the exemplary embodiment, each passage 264 has the same diameter $D_O$. Alternatively, each passage 264 may have any shape, size, and/or orientation that enables engine 100 to function as described herein.

Each airfoil 212, in the exemplary embodiment, includes an airfoil passageway 280. A centerline 282 of each airfoil passageway 280 is oriented substantially parallel to turbine radius R. Alternatively, passageway centerline 282 is oriented obliquely with respect to turbine radius R. In the exemplary embodiment, passageway 280 is defined through a widest portion 284 of each airfoil 212 such that the external geometry of airfoil 212 is not altered by passageway 280. Alternatively, passageway 280 may be defined within airfoil 212 at any suitable location that enables engine 100 to function as described herein and/or that ensures an external geometry of airfoil 212 is not dependent upon passageway 280.

Furthermore, in the exemplary embodiment, each passageway 280 has the same diameter $D_A$. Alternatively, each passageway 280 may have any shape, size, and/or orientation that enables engine 100 to function as described herein. Diameter $D_A$ is smaller than diameter $D_O$ in the exemplary embodiment. In other embodiments, diameter $D_A$ may be larger than, or approximately equal to, diameter $D_O$. Moreover, in the exemplary embodiment, an inlet 286 of airfoil passageway 280 is substantially aligned with an outlet 288 of outer ring passage 264, and an outlet 290 of airfoil passageway 280 is in flow communication with inner plenum 242. More specifically, in the exemplary embodiment, airfoil passageway centerline 282 is substantially coaxial with outer ring passage centerline 278. Alternatively, centerline 282 may be offset and/or oriented obliquely with respect to centerline 278.

In the exemplary embodiment, the number of outer ring outlets 288 is equal to the number of airfoils 212 coupled within outer ring first portion 270. Similarly, the number of outlets 244 is equal to the number of airfoils 212 coupled within outer ring first portion 270. In an alternative embodiment, the number of outer ring outlets 288 is greater than, or less than, the number of airfoils 212 coupled within outer ring first portion 270, and/or the number of outlets 244 is greater than, or less than, the number of airfoils 212 coupled within outer ring first portion 270. In another embodiment, the number of outer ring outlets 288 is equal to the number of airfoils 212 coupled within outer ring first portion 270, and/or the number of outlets 244 is equal to the number of airfoils 212 coupled within diaphragm 204. In yet another embodiment, the number of outer ring outlets 288 and/or the number of outlets 244 is not dependent upon the number of airfoils 212. Alternatively, the number and/or sizing of plenum 242 and/or 262, passageway 280, passage 264, outlet 244 and/or airfoils 212 that include passageway 280 therethrough may be selected to control an amount of cooling fluid 236 supplied to stage 200 and/or a velocity of fluid 236 in passageways 280, passages 264, and/or outlets 244.

During operation of engine 100, steam 144 is channeled to high-pressure section 102 through high-pressure steam inlet 120 and along main flowpath 214, and cooling fluid 236, such as cooling steam, is channeled to stage 200 via one or more pipes or passageways (not shown) that penetrate shell 106 near outer ring 228. Steam seal 252 facilitates preventing steam 144 from entering outer plenum 262 and/or fluid 236 from discharging from outer plenum 262 into main flowpath 214. Steam 144 is channeled between airfoils 212 to buckets 202 to rotate rotor shaft 140. Seals 222, 260, and/or 238 facilitate ensuring that steam 144 travels along main flowpath 214 and also facilitate preventing leaks within high-pressure section 102.

Cooling fluid 236 may be channeled from any suitable cooling fluid source, such as, for example, a cooling steam source outside of shell 106 and/or 112, a downstream stage (not shown), and/or a leakage flow within engine 100. In the exemplary embodiment, cooling fluid 236 enters outer plenum 262 and/or channel 272 and is discharged from outer ring 228 through passages 264. Cooling fluid 236 discharged from passages 264 enters airfoil passageways 280, and is then channeled through airfoil passageways 280 prior to being discharged from outlets 290. Cooling fluid 236 enters inner plenum 242 from passageways 280. Cooling fluid 236 is then channeled though outlets 244 into wheelspace 216 to facilitate cooling wheel 206 and/or wheelspace 216. In the exemplary embodiment, cooling fluid 236 is discharged from wheelspace 216 along any suitable leakage flow path that enables cooling fluid 236 to enter main flowpath 214, through rotor seal 234, seal 238, and/or balance holes (not shown), and/or along any other suitable path that enables engine 100 to function as described herein.

The above-described methods and apparatus facilitate cooling a rotary component within a steam turbine without modifying component external geometries, component materials, and/or steam temperature and/or pressure. More specifically, the above-described diaphragm has limited, or no, impact on the flowpath physical geometry while providing the necessary cooling steam to enable reliable long-term operation of a bucketed steam turbine rotor.

Furthermore, the above-described airfoils include passageways through which a cooling fluid may flow radially inwards, although airfoils used in HP and IP sections of steam turbines have historically been solid sections. As such, the above-described airfoils facilitate cooling rotary components without requiring piping within the flowpath that disturbs the steam flow. Moreover, the passageways internal to the airfoils do not affect an external contour of the airfoils. Additionally, the plenum, passageway, passage, and/or outlet sizing and/or the number of airfoils that include a passageway therethrough may be selected to control the amount of cooling fluid supplied and/or the velocity of the fluid in the passageways, passages, and/or outlets.

Moreover, the above-described diaphragm facilitates cooling a fluid within a wheelspace adjacent to a rotary component by lower a temperature within the wheelspace. Such wheelspace temperature reduction reduces a bulk temperature of the adjacent rotary component. Furthermore, by channeling the cooling fluid radially inward from a radially outer surface of the diaphragm through an outer ring, an airfoil, and an inner ring, the temperature of the outer ring, airfoil, and/or inner ring is facilitated to be reduced as compared to diaphragms that do not include a cooling fluid flowpath therethrough. The above-described cooling fluid flowpath supplies a cooling steam flow through a unmodified, known stage geometry to cool a rotor wheel.

The above-described method, which brings cooling steam from outside the sealed outer and/or inner shells to the wheelspace across the flowpath, facilitates minimizing an adverse effect on turbine performance by minimizing the geometric impact on the steampath, as compared to designs that include pipes positioned within the steampath.

Exemplary embodiments of a method and apparatus for cooling a rotary component within a steam turbine are described above in detail. The method and apparatus are not limited to the specific embodiments described herein, but rather, components of the method and apparatus may be utilized independently and separately from other components described herein. For example, the diaphragm may also be used in combination with other steam turbine systems and methods, and is not limited to practice with only the high-pressure steam turbine section as described herein. Rather, the present invention can be implemented and utilized in connection with many other steam turbine cooling applications.

While the invention has been described in terms of various specific embodiments, those skilled in the art will recognize that the invention can be practiced with modification within the spirit and scope of the claims.

What is claimed is:

1. A method for cooling a rotating component within a steam turbine, said method comprising:

channeling a cooling fluid through an outer plenum defined in an outer ring of a stationary component of the steam turbine;

channeling the cooling fluid from the outer plenum, through a passage defined between the outer plenum and an airfoil of the stationary component, and through a passageway defined in the airfoil, wherein the portion of the passage defined in the outer ring has a first diameter that is larger than a second diameter defined in the airfoil passageway; and discharging the cooling fluid from the airfoil passageway through an inner plenum of the stationary component to facilitate cooling an adjacent rotating component.

2. A method in accordance with claim 1 wherein channeling the cooling fluid from the outer plenum further comprises channeling the cooling fluid through the portion of the airfoil passageway that is substantially coaxially aligned within the outer ring passage.

3. A method in accordance with claim 2 wherein channeling the cooling fluid through an opening further comprises channeling the cooling fluid though a plurality of openings, wherein the number of openings corresponds to a number of airfoils included within the stationary component.

4. A method in accordance with claim 1 wherein channeling the cooling fluid from the passageway through an inner plenum further comprises channeling the cooling fluid from the inner plenum through at least one outlet configured to discharge the cooling fluid downstream from the stationary component.

5. A method in accordance with claim 4 wherein channeling the cooling fluid from the inner plenum through at least one outlet further comprises channeling the cooling fluid through a plurality of outlets, wherein the number of outlets corresponds to a number of airfoils within the stationary component.

6. A method in accordance with claim 1 wherein channeling a cooling fluid through an outer plenum further comprises channeling steam through the outer plenum.

7. A method in accordance with claim 1 further comprising sealing the outer plenum from a main steam path.

8. An annular stationary component for use with a steam turbine, said stationary component comprising:

a first ring comprising a first plenum defined therein, and a plurality of passages coupled to said first plenum and extending outwardly from said first plenum;

a second ring comprising a second plenum and at least one outlet defined therein, said second plenum coupled in flow communication with said at least one outlet, said second ring radially inward from said first ring; and at least one airfoil extending between said first ring and said second ring, said at least one airfoil comprising a passageway extending therethrough from a first end of said airfoil to a second end of said airfoil, said airfoil passageway coupled to at least one first ring passage of said plurality of first ring passages and said second plenum, wherein said at least one first ring passage has a first diameter, said airfoil passageway has a second diameter that is smaller than said first diameter.

9. A stationary component in accordance with claim 8 wherein said first plenum is defined in a radially outer surface of said first ring, said second plenum is defined in a radially outer surface of said second ring.

10. A stationary component in accordance with claim 8 wherein said plurality of first ring passages extend from said first plenum to a radially inner surface of said first ring.

11. A stationary component in accordance with claim 10 wherein said airfoil passageway is aligned substantially coaxially with said at least one first ring passage.

12. A stationary component in accordance with claim 8 wherein said at least one outlet is configured to discharge a cooling fluid into a wheelspace downstream from said stationary component.

13. A stationary component in accordance with claim 8 wherein said second ring comprises a plurality of outlets defined therethrough, wherein the number of said outlets corresponds to the number of said airfoils extending between said first ring and said second ring.

14. A steam turbine comprising:

a rotor shaft;

at least one rotor wheel coupled to said rotor shaft;

a plurality of buckets coupled to said at least one rotor wheel;

a stationary component coupled to a steam turbine casing, said stationary component coupled upstream from said plurality of buckets such that a wheelspace is defined between an upstream surface of said rotor wheel and a downstream surface of said stationary component, said stationary component comprising:

a first ring coupled to said steam turbine, said first ring comprising a first plenum and a plurality of passages coupled to said first plenum and extending outwardly from said first plenum toward said rotor shaft;

a second ring coupled to said steam turbine radially inward from said first ring, said second ring comprising at least one outlet extending through said component downstream surface and coupled in flow communication with said wheelspace; and at least one airfoil extending between said first ring and said second ring, said at least one airfoil comprising an airfoil passa d between at least one first ring passage of said plurality of first ring passages and said at least one outlet, said at least one ring passage has a first diameter, said airfoil passageway has a second diameter that is smaller than said first diameter; and a cooling fluid flowpath defined through at least said plurality of first ring passages, said airfoil passageway, and said second ring outlet, wherein said cooling fluid flowpath is configured to channel a cooling fluid to said wheelspace.

15. A steam turbine in accordance with claim 14 wherein said first plenum is defined in a radially outer surface of said first ring.

16. A steam turbine in accordance with claim 15 wherein each said first ring passage of said plurality of first ring passages extends from said first plenum to a radially inner surface of said first ring.

17. A steam turbine in accordance with claim 15 wherein said first ring comprises a seal coupled between said first plenum and a main steam flowpath, wherein said main steam flowpath is defined through said plurality of buckets and said stationary component.

18. A steam turbine in accordance with claim 14 wherein said second ring comprises a second plenum defined therein, said cooling fluid flowpath comprising said second plenum.

19. A steam turbine in accordance with claim 18 wherein said second ring outlet extends from said second plenum to said wheelspace.

20. A steam turbine in accordance with claim 14 wherein said airfoil passageway extends from a first end of said at least one airfoil to a second end of said at least one airfoil, and wherein said first end is radially outward from said second end.

* * * * *